US005448210A

United States Patent [19]

Marcoux

[11] Patent Number: 5,448,210

[45] Date of Patent: Sep. 5, 1995

[54] TUNABLE MICROWAVE BANDSTOP FILTER DEVICE

[75] Inventor: Jean Marcoux, Magny Les Hameaux, France

[73] Assignee: Dassault Electronique, Saint Cloud, France

[21] Appl. No.: 980,794

[22] PCT Filed: Jun. 25, 1992

[86] PCT No.: PCT/FR92/00585

§ 371 Date: Mar. 1, 1993

§ 102(e) Date: Mar. 1, 1993

[87] PCT Pub. No.: WO93/00718

PCT Pub. Date: Jan. 7, 1993

[30] Foreign Application Priority Data

Jun. 27, 1991 [FR] France ..... 91 08003

[51] Int. Cl.[6] ..... H01P 1/203

[52] U.S. Cl. ..... 333/205; 333/235

[58] Field of Search ..... 333/202–205, 333/219, 235; 334/15

[56] References Cited

U.S. PATENT DOCUMENTS

| | | | |
|---|---|---|---|
| 4,004,257 | 1/1977 | Geissler | 333/243 |
| 4,467,296 | 8/1984 | Cohen et al. | 333/205 X |
| 4,468,644 | 8/1984 | Teague et al. | 333/176 X |
| 4,835,499 | 5/1989 | Pickett | 333/205 |
| 5,065,119 | 11/1991 | Jachowski | 333/202 |
| 5,150,085 | 9/1992 | Hales | 333/207 X |

FOREIGN PATENT DOCUMENTS 0337825 10/1989 European Pat. Off. .

OTHER PUBLICATIONS

Mehrdad Mehdizadeh et al., "High Speed Varactor Tuned Notch Filter," 1985 IEEE MTT-S Digest, pp. 531–534.

J. L. Lacombe, "Switchable Band-Stop Filter for M.I.C.," 14th European Microwave Conference, Conference Proceedings, Sep. 10–13, 1984, pp. 376–381.

W. J. Getsinger, "Circuit Duals on Planar Transmission Media," 1983 IEEE MTT-S Digest, pp. 154–156.

I. C. Hunter et al., "Electronically Tunable Microwave Bandstop Filters," IEEE Transactions on Microwave Theory and Techniques, vol. MTT-30, No. 9, Sep. 1982, pp. 1361–1367.

*Primary Examiner*—Seungsook Ham

*Attorney, Agent, or Firm*—Foley & Lardner

[57] ABSTRACT

A tunable microwave bandstop filter device comprises a main microwave transmission line (1), at least one filter cell comprising a coupled line segment (4) coupled to the main transmission line (1) and arranged parallel to and remotely from the latter, and also a tunable LC resonant circuit (5, 6). According to the invention, the tunable LC resonant circuit (5, 6) is placed between one of the ends of the line segment (4) and the main microwave transmission line (1).

23 Claims, 5 Drawing Sheets

TUNABLE MICROWAVE BANDSTOP FILTER DEVICE

BACKGROUND OF THE INVENTION

The invention relates to the field of microwave bandstop filters.

It finds general application in the processing of microwave signals and more particularly in the microwave receiving stages for which it may be necessary to filter unstable noise signals of generally unknown frequency to be able to analyze and identify useful signals with a good signal-to-noise ratio.

Tunable microwave bandstop filter devices are already known.

For example, in French patent No. 88 03187 published under the number 2 628 571, the THOMSON company proposed a tunable microwave bandstop filter device which comprises:

- a main microwave transmission line using stripline technology, and
- at least one filter cell comprising a coupled microwave line segment coupled to the main transmission line and arranged parallel to and remotely from the latter, and a tunable LC resonant circuit.

A signal applied to one of the ends of the transmission line is filtered and the centre frequency of the filtering device thus obtained can be varied by controlling the voltage applied to the tunable LC resonant circuit.

In patent No. 88 03187, the segment of the stripline has an open-circuit first end and a second end connected to ground potential via the tunable LC resonant circuit containing in particular a varactor diode.

Such an arrangement has the following drawbacks.

Firstly, the connection from the second end of the stripline segment to the ground potential via the resonant circuit is made by means of a plated-through hole which, at microwave frequencies, gives rise to residual inductance of a typical value of 0.2 to 0.3 nanohenrys. Now the consequence of this is to limit the application of the filter device to the high-frequency range (typically above 12 GHz). Furthermore, the losses associated with this plated-through hole reduce the overall performance of the filter and in particular the Q-factor of the resonant circuit.

Next, to ensure proper filter operation the access from the plated-through hole to the earth plane must be easy and rapid. But this excludes so-called suspended substrate technology and stripline type technology has to be used exclusively.

Finally, the filter cell supplying the varactor diode in the above-mentioned patent is very difficult to produce for operations in a very wide usable band and/or with a very high tuning speed.

SUMMARY OF THE INVENTION

One of the aims of the invention is to remedy these drawbacks.

To this end, the invention proposes a new arrangement which enables the coupling of the tunable LC resonant circuit to be modified.

According to a principal feature of the invention the tunable LC resonant circuit is placed between one of the ends of the coupled line segment and the main microwave transmission line.

This arrangement according to the invention, which is derived from the fixed-frequency arrangement referred to by the expert as "SPURLINE", exhibits the following advantages:

- simple use of components and trouble-free micro-electronics integration;
- elimination of the microwave plated-through hole;
- improvement in performance, particularly with regard to the width of the usable band and the tuning frequency;
- wider choice of transmission line technology, in particular the possibility of using suspended substrate technology.

According to a preferred way of carrying out the invention, the tunable LC resonant circuit contains an inductor placed in series with a variable capacitance, the other end of the coupled line segment being open-circuit.

In this case the variable capacitance is advantageously comprised of a varactor diode, one of whose electrodes is connected to one end of the coupled line segment and whose other electrode is, on the one hand, connected to one of the terminals of the inductor and, on the other hand, to a control circuit.

According to another preferred way of carrying out the invention, the tunable LC resonant circuit contains an inductor placed in parallel with a variable capacitance, the other end of the coupled line segment being connected to ground.

However, this last arrangement has the drawback of requiring a microwave plated-through hole.

In conventional filter arrangements the varactor diode is controlled by a control circuit comprising a voltage source decoupled from radio frequencies by a self-inductance or by a diplexer.

The applicant is faced with the problem of controlling the varactor diode in a simpler way and at low cost, at the same time improving the low-frequency performance of the filter, that is to say at frequencies below 2 GHz.

According to the invention, the solution to this problem consists in using a control circuit containing a high ohmic resistance which has little or no effect on the operation at microwave frequencies.

The principle of operation of a varactor diode being that of a reverse-biased diode, the current supplied by such a control circuit according to the invention is negligible and the control voltage is completely transmitted to the varactor diode.

Such a control circuit provides the following advantages:

- simple use of the resistance and trouble-free and easier micro-electronics integration;
- better maintenance of the impedance of the control circuit of the varactor diode at high values at wideband microwave frequencies, and thus improvement in the flatness of the electrical response of the said varactor diode control circuit;
- absence of filtering effect in the control circuit of the varactor diode, and therefore possible extension of the use of the filter device into the low frequencies; and
- possibility of connecting the control circuit of the varactor diode to the varactor diode itself or to the connection between the tunable LC resonant circuit and the main transmission line.

Within the context of wideband operation from 2 to 18 GHz, for example, the filter device according to the invention is used as a bandstop or rejector, where it cuts out a narrow filter band and positions the latter in the wide band from 2 to 18 GHz.

According to the general theory of this type of microwave filter, when the said filter operates at a quarter-wavelength at the center rejection frequency of the filter, it also operates at three-times the quarter-wavelength (this being strictly true for fixed-frequency filters).

For example, when the filter of the patent mentioned above operates at 4 GHz, it will equally act as a rejector at another frequency between 8 and 12 GHz.

Now this spurious rejection between 8 and 12 GHz is very inconvenient in relation to wideband operation from 2 to 18 GHz.

It is worth noting that the conditions of resonance of a filter according to the invention for variable frequencies are different from those for fixed frequencies. More specifically, the conditions of resonance for variable frequencies are such that spurious rejection appears not so much at three-times the reference frequency, but more nearly twice; the reference frequency being the frequency at which the elementary structure corresponds to a quarter-wavelength.

The result is that it is even more difficult to operate at variable frequencies with regard to the first part of the 2 to 18 GHz band without being bothered by the said spurious rejection.

This is why, in practice, the filter of the above-mentioned patent only rejects from 6.5 GHz.

Another aim of the invention is precisely to provide a tunable microwave bandstop filter device able to efficiently reject at low frequencies, at the same time retaining a useful band above or equal to the 2 to 18 GHz band.

To this end, the invention uses a filter device of the type mentioned above.

According to another important feature of the invention, the main microwave transmission line is subdivided into two adjacent sections, the line segment being coupled to the first section of selected electrical length L1, the second section being free and of selected electrical length L2, and the sum of the lengths L1 and L2 being more or less equivalent to a quarter-wavelength at the centre rejection frequency of the filter.

The expert will understand that such an arrangement can be used in a filter comprising a number of filter cells, the main microwave transmission line thus being subdivided into several pairs of sections arranged as stated above.

It should be noted that the choice of lengths L1, L2 and L1+L2 enables adequate phasing to be maintained between each filter cell.

Moreover, the choice of the length L1 of the first section enables the spurious stop band to be displaced to more than twice the value Vg/4.L1, where Vg is the group velocity in the transmission medium for operating the rejector filter device centred on Vg/4(L1+L2).

Thus, thanks to the invention, it will be possible to operate at variable frequencies in the first part of the 2 to 18 GHz band without being bothered by spurious rejection.

In a practical example, the length L1 is of the order of 3.3 mm, the length L2 approximately 1.7 mm and the centre rejection frequency of the filter is 6 GHz.

BRIEF DESCRIPTION OF THE DRAWINGS

Other features and advantages of the invention will be revealed in the detailed description below and the drawings, which show.

DESCRIPTION OF THE PREFERRED EMBODIMENTS

Figure 1:
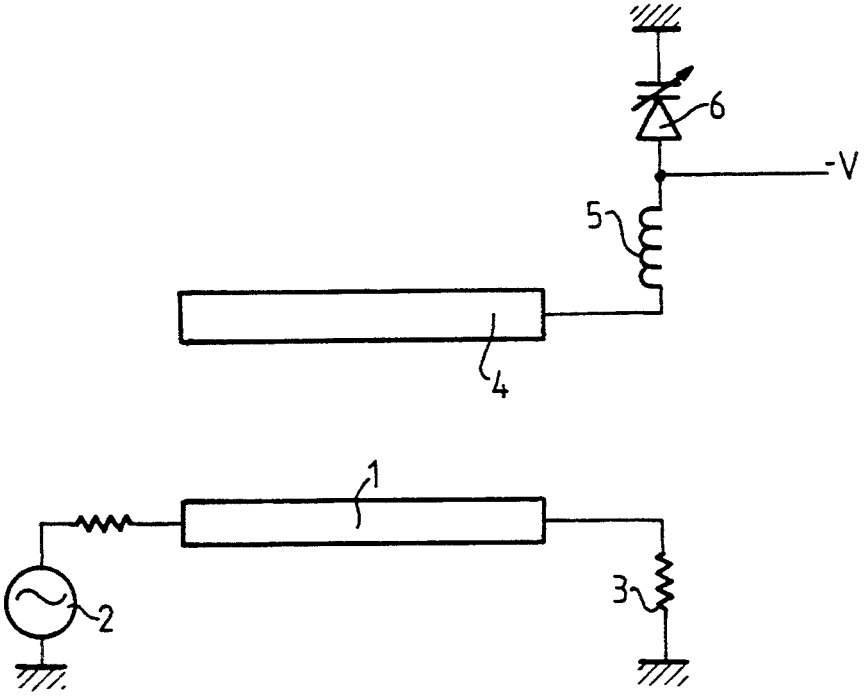
FIG.1 PRIOR ART
FIG. 1 a schematic representation of a tunable microwave filter device according to the prior art.

The arrangement claimed in French patent No. 88 03187 relating to a bandstop filter of the so-called coupled line type produced using stripline technology is shown in FIG. 1.

Such a filter comprises a transmission line 1 in the form of a stripline or microstrip connecting a microwave frequency generator 2 to a load impedance 3.

At least one filter cell is provided, formed from a stripline segment 4 arranged parallel to the transmission line and having an electric length approximately equal to a quarter-wavelength at the filter's intended centre rejection frequency.

One end of the segment 4 is open-circuit and the other end is connected to ground via an LC resonant circuit formed from an inductor 5 in series with a variable capacitance 6, this circuit thus forming a load for the coupled line.

In practice, the variable capacitance 6 is formed by a varactor diode whose cathode is connected to ground and whose anode is connected, on the one hand, to one of the terminals of the inductor 5 and, on the other hand, to a negative d.c. voltage source −V.

The filter device may comprise, for example, 5 filter cells—each formed from one segment 4. It should be noted that the shape of the filter response curve can be adjusted by increasing the number of cells.

Figure 2:
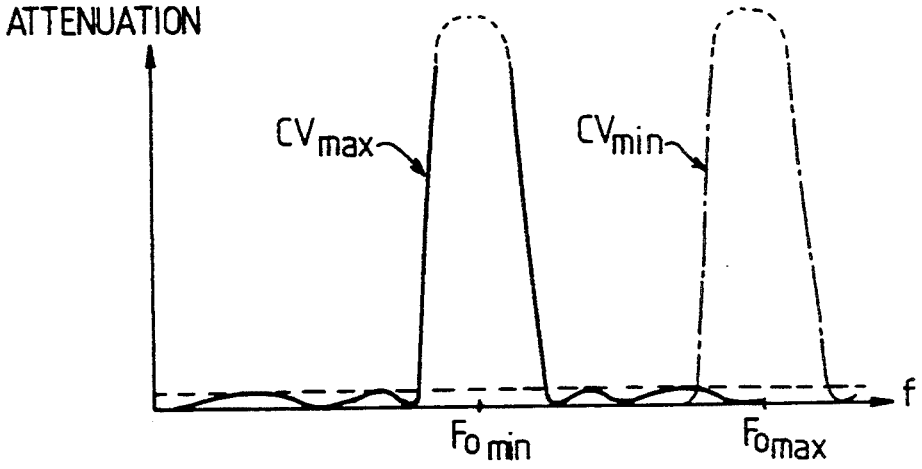
FIG. 2 an attenuation curve of the filter described with reference to FIG. 1.

The attenuation obtained by such a filter is shown in FIG. 2, where it can be seen that the centre frequency FO may be displaced between a minimum value $FO_{min}$ and a maximum value $FO_{max}$ in relation to the potential applied to the cathode of the varactor diode, the minimum frequency being obtained by the maximum capacitance of the varactor diode, this corresponding to the lowest control voltage.

The center frequency FO is determined by the length of each segment 4 and the width of the displaced band depends on the number of cells and the impedance of the coupled line between each one of them.

Figure 3:
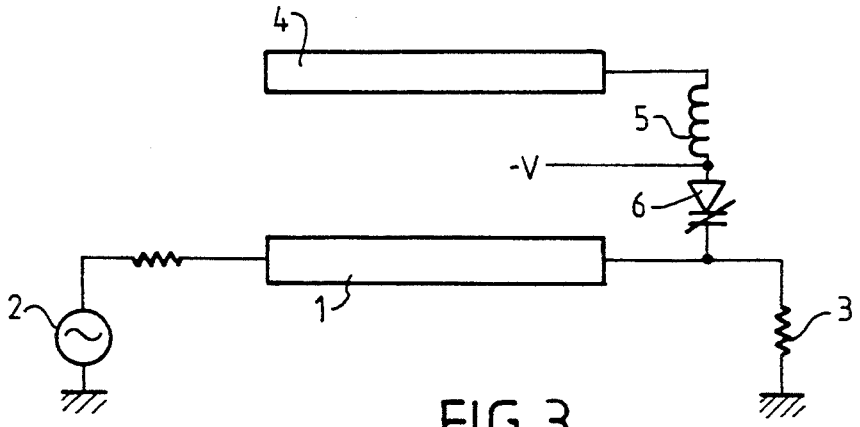
FIG. 3 is a schematic view of a filter cell with an LC resonant circuit placed in series between the main transmission line and the coupled line segment according to the invention.

According to the invention, as shown by FIG. 3, the connection of the tunable LC resonant circuit is modified. Thus, according to the invention the tunable LC resonant circuit remains between one end of the stripline segment 4 and the microwave transmission line 1.

More specifically, the variable capacitance 6 is formed by a varactor diode whose cathode is connected to one end of the transmission line 1 and whose anode is connected, on the one hand, to one of the terminals of the inductor 5 and, on the other hand, to a negative d.c. voltage source −V.

The capacitance of the varactor diode being a function of the d.c. potential applied to its terminals, the tuned frequency of the LC resonant circuit varies with the control voltage of the varactor diode.

The operation of the filter is therefore modified and its frequency tuning basically depends on the d.c. voltage applied to the varactor diode.

Obviously it is possible to install several filter cells around the transmission line. In this case all the potentials −V are varied simultaneously in order to maintain the correct tuning of the filter.

The attenuation obtained by such a filter is more or less identical to that shown in FIG. 2.

It should be noted that the arrangement shown in FIG. 3 has the advantage of being capable of being implemented using stripline technology and also suspended substrate technology, thanks to the absence of plated-through holes.

Figure 4:
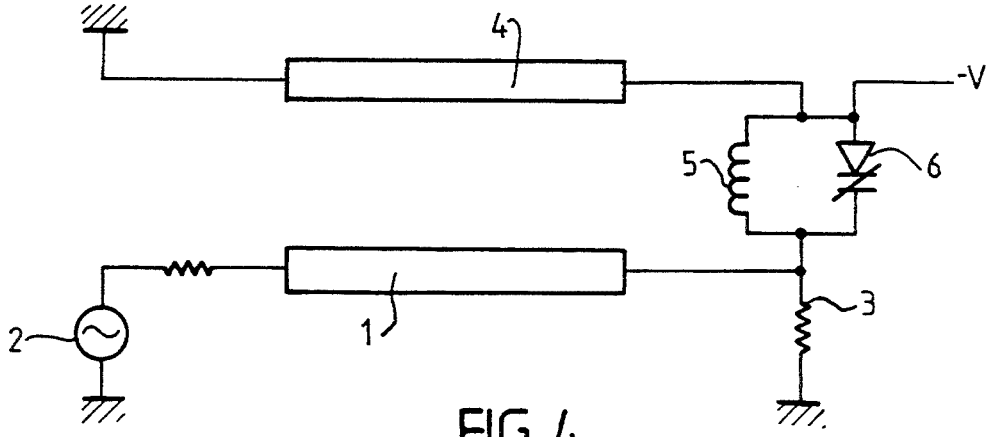
FIG. 4 is a schematic view of a filter cell with an LC circuit placed in parallel between the main transmission line and the coupled line segment according to the invention.

In FIG. 4, the tunable LC resonant circuit that is placed between one end of the stripline segment and the microwave transmission line, comprises an inductor 5 connected in parallel with a variable capacitance 6.

It should be noted that the other end of the stripline segment 4 is connected to ground potential.

More specifically, the variable capacitance is formed by a varactor diode whose cathode is connected to one end of the microwave transmission line and whose anode is connected, on the one hand, to the stripline and, on the other hand, to the control circuit.

Figure 5:
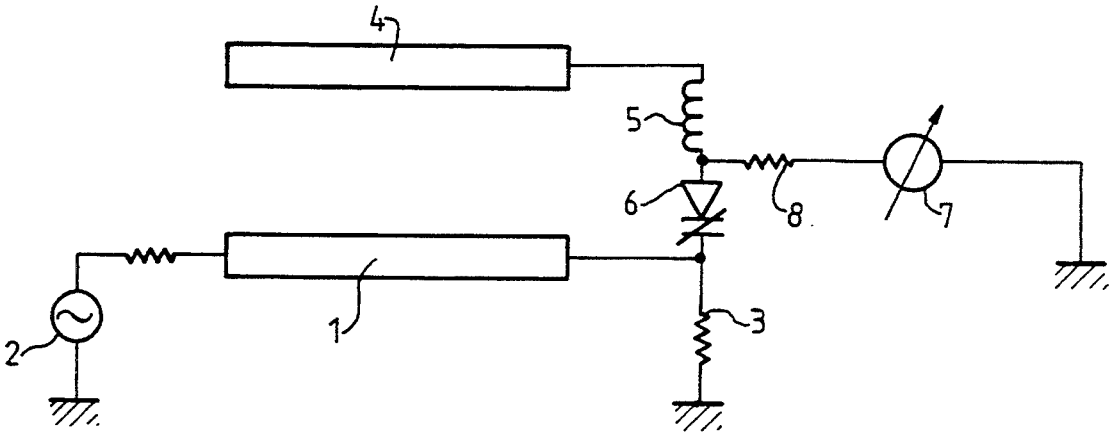
FIG. 5 is a schematic view of the control circuit of the varactor diode used in conjunction with the device described with reference to FIG. 3.

In FIG. 5, the filter device described with reference to FIG. 3 appears again.

According to the invention, the varactor diode control circuit contains a voltage source 7 which supplies the varactor diode via a resistor 8 having a high ohmic value.

For example, for correct operation of the varactor diode the ohmic value of the resistor 8 is of the order of several thousands of ohms.

Figure 6:
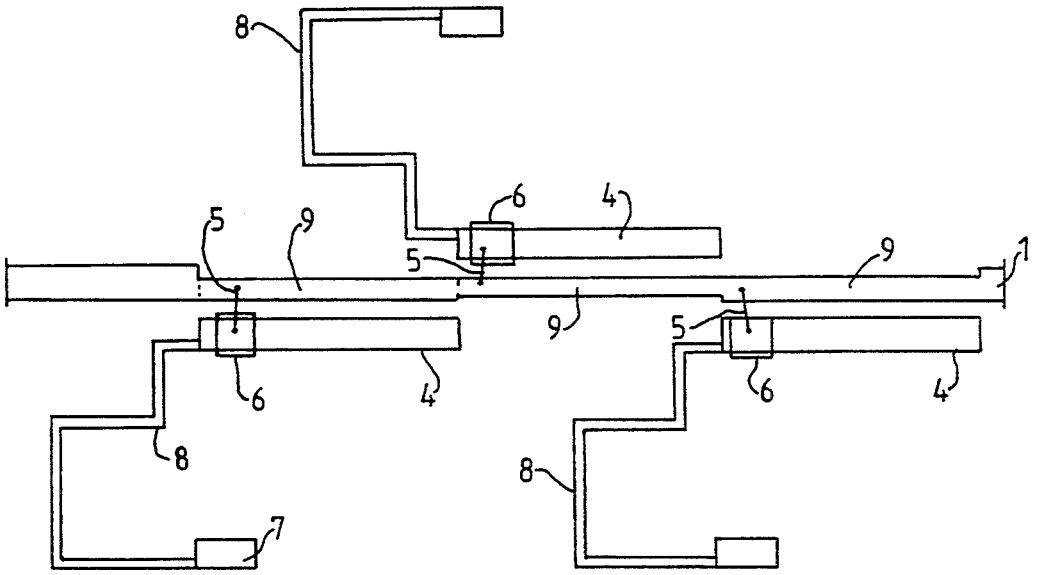
FIG. 6 is a schematic view of a mask of a device with three filter cells shown in FIGS. 3 and 5 according to the invention.

FIG. 6 shows a mask, using stripline technology, of a filter device with three filter cells of the type described with reference to FIGS. 3 and 5.

The main microwave transmission line 1, to which three filter cells are connected, is shown again here.

One filter cell consists of a line segment 4 coupled to a line section 9, and a tunable LC resonant circuit placed between the section 9 and the segment 4.

The LC resonant circuit consists of a varactor diode 6 and an inductor 5.

In stripline technology the varactor diode 6 consists of a pad attached to the line segment 4 and the inductor 5 consists of a connecting wire placed between the varactor diode 6 and the line section 9.

The resistor 8 of the varactor diode control circuit consists of a strip connected to one end of the line segment 4. The voltage source 7 supplies the resistor 8.

Advantageously, the resistor 8 is positioned as close as possible to the varactor diode, but due to practical constraints it may have to be positioned at any point on the line segment, for example.

It should be noted that the adjacent sections 9 have an electrical length approximately equal to that of the line segments 4. This length more or less corresponds to a quarter-wavelength at the center rejection frequency of the filter. For example, for a center rejection frequency of 6 GHz, the length of the sections 9 and segments 4 is of the order of 5 mm.

Figure 7:
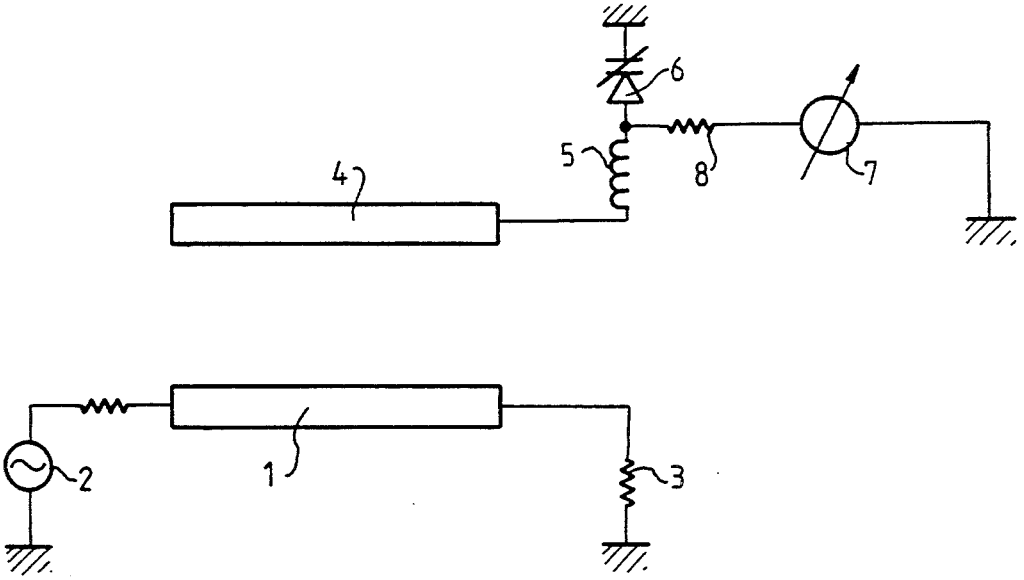
FIG. 7 is a schematic view of the varactor diode control circuit used in conjunction with the device in FIG. 1 according to the invention.

The control circuit of the filter device described with reference to FIG. 1 is represented in FIG. 7.

Here again is the control circuit described with reference to FIG. 5, comprised of a resistor 8 of high ohmic value and a voltage source 7 which is connected to the anode of the varactor diode 6.

Figure 8:
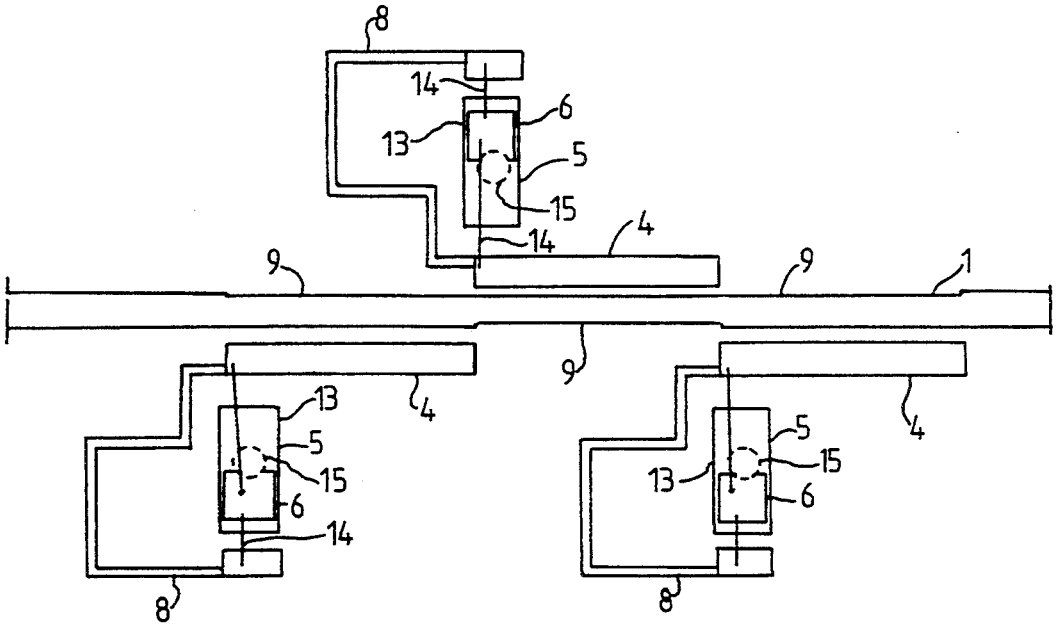
FIG. 8 is a schematic view of a mask of a device with three filter cells shown in FIGS. 1 and 7 according to the invention.

A mask, using stripline technology, of a filter device with three cells of the type described with reference to FIGS. 1 and 7, is shown in FIG. 8.

Here again is the main microwave transmission line 1 to which three filter cells are connected.

Each filter cell is formed by a line segment 4 coupled to a line section 9, and a tunable LC resonant circuit placed between the ground and one end of the line segment 4.

In stripline technology the ground is represented by a plated-through hole 15 (broken line in FIG. 8).

The inductor 5 is formed by a block 13 to which is attached the pad 6 forming the varactor diode. Connecting wires 14 connect the varactor diode 6 to the resistor 8 of the control circuit of the said varactor diode according to the invention.

As in FIG. 6, the adjacent line sections 9 have an electrical length approximately equal to that of the line segments 4.

This electrical length more or less corresponds to a quarter-wavelength at the center rejection frequency of the filter.

Figure 9:
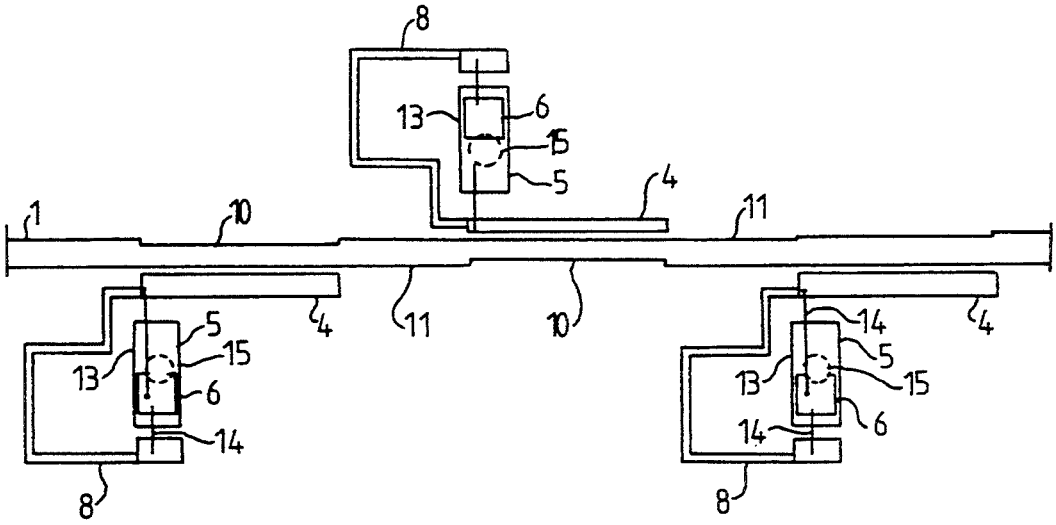
FIG. 9 is a schematic view of the subdivision of the main transmission line used in conjunction with the three filter cells in FIG. 8 according to the invention.

FIG. 9 shows a mask of a filter device having its microwave transmission line subdivided into several adjacent sections of different electrical length to displace the spurious rejection frequencies to beyond the useful band of 2 to 18 GHz.

In this case the filter device is used in conjunction with three filter cells, such as those described with reference to FIGS. 1 and 8.

According to the invention, the microwave transmission line is subdivided into a number of adjacent pairs of segments 10 and 11.

The line segment 4 of each filter cell is coupled to the first section 10 of electrical length L1.

The second section 11, adjacent to section 10, is free. It has an electrical length L2.

In order to maintain adequate phasing between each filter cell, the sum of the lengths L1 and L2 is chosen so that it is roughly equal to a quarter-wavelength at the center rejection frequency of the filter.

For example, with L1 equal to 3.3 mm, L2 equal to 1.7 mm and with a center frequency of 6 GHz, the applicant has found, surprisingly, that the spurious rejection frequencies appear above 18 GHz.

Figure 10:
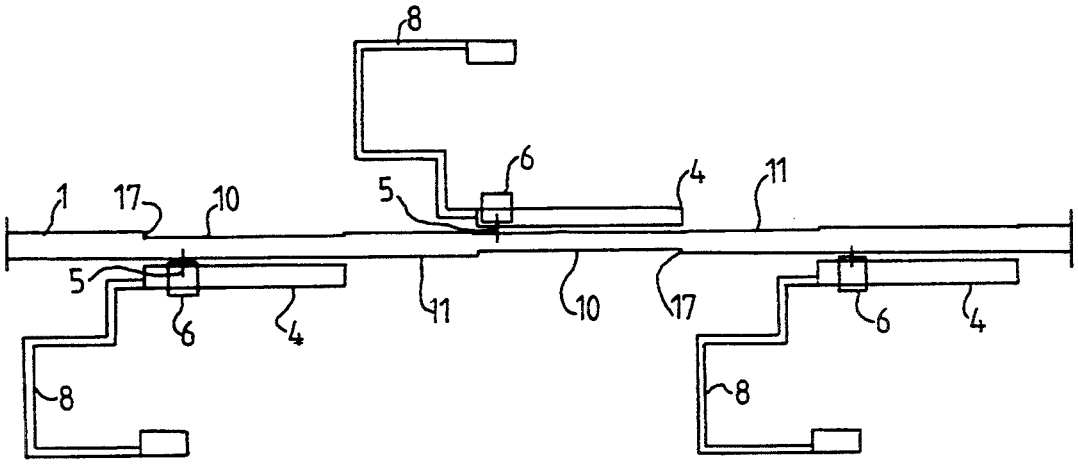
FIG. 10 is a schematic view of the subdivision of the main transmission line used in conjunction with the three filter cells in FIG. 9 according to the invention.

A mask of a filter device with three filter cells of the type described with reference to FIGS. 3, 5 and 6 is represented in FIG. 10.

According to the invention, the main transmission line 1 is subdivided into a number of pairs of adjacent sections 10 and 11 to shift spurious rejection frequencies to beyond 18 GHz.

It should be noted that the sections 10 and 11 are bounded by shoulders 17.

It should be noted that, generally speaking, the coupled line segments 4 have a width that is equal to that of the main transmission line 1.

As a variant, they may also be produced (for example the coupled line segment 4 of the main cell in FIG. 10) from lines of different widths. Such a variant has the advantage of introducing a degree of additional reliability which may be useful in the synthesis of the filter or in the adjustment of the filter parameters, such as the width of the rejection band of the filter with respect to the tuned frequency.

The invention is not limited to the methods of implementation described above, but includes all the variants that are contained within the context of the claims below.

I claim:

1. A tunable microwave bandstop filter device having a center rejection frequency and comprising:

a main microwave transmission line;

at least one filter cell comprising a coupled line segment having an electrical length substantially corresponding to a quarter-wavelength at said center rejection frequency of said filter, coupled to said main transmission line and arranged parallel to and remotely from said main transmission line, and a tunable LC resonant circuit, said tunable LC resonant circuit being directly connected between one end of said coupled line segment and said main microwave transmission line.

2. A device according to claim 1, wherein said tunable LC resonant circuit comprises an inductor connected in series with a variable capacitance.

3. A device according to claim 2, wherein said coupled line segment has another end and wherein said other end of said coupled line segment is open-circuited.

4. A device according to claim 1, wherein said tunable LC resonant circuit comprises an inductor connected in parallel with a variable capacitance.

5. A device according to claim 4, wherein said coupled line segment has another end, and wherein said other end of said coupled line segment is connected to ground potential.

6. A device according to claim 2, wherein said variable capacitance is formed by a varactor diode comprising a first electrode connected to said main microwave transmission line and a second electrode connected to said inductor.

7. A device according to claim 4, wherein said variable capacitance is formed by a varactor diode comprising a first electrode connected to said main microwave transmission line and a second electrode connected to said inductor.

8. A device according to claim 6, wherein said second electrode of said varactor diode is further connected to a control circuit controlling said center rejection frequency of said filter and comprising a resistor of high ohmic value and a voltage generator supplying said resistor.

9. A device according to claim 6, wherein said second electrode of said varactor diode is further connected to a control circuit of said center rejection frequency of said filter comprising a resistor of high ohmic value and a voltage generator supplying said resistor in order to voltage-control said varactor diode.

10. A device according to claim 1, wherein said main microwave transmission line utilizes stripline technology.

11. A device according to claim, 1, wherein said main microwave transmission line utilizes suspended substrate technology.

12. A device according to claim 1, wherein said tunable LC resonant circuit comprises an inductor connected in series with a variable capacitance and said coupled line segment has another end, said other end of said coupled line segment being open circuited.

13. A device according to claim 1, wherein said tunable LC resonant circuit comprises an inductor connected in parallel with a variable capacitance, and said coupled line segment has another end, said other end of said coupled line segment being connected to ground potential.

14. A device according to claim 12, characterised in that the variable capacitance is formed by a varactor diode, one of whose electrodes is connected to one end of the main transmission line and whose other electrode is connected to one of the terminals of the inductor and to a control circuit.

15. A device according to claim 1, wherein the coupled line segment has a width that is about equal to that of the main transmission line.

16. A device according to claim 1, wherein the coupled line segment has a width that is different from that of the main transmission line.

17. A tunable microwave bandstop filter, comprising:

a main microwave transmission line;

at least one filter cell comprising a line segment having an electrical length of about one quarter wavelength a center rejection frequency of the filter and coupled to the main transmission line and arranged parallel to and remotely from the main transmission line, and a tunable LC resonant circuit directly connected between one end of the line segment and the microwave transmission line, the tunable LC resonant circuit comprising a varactor diode that is voltage-controlled by a control circuit;

wherein the control circuit comprises a resistor of high ohmic value and is supplied by a voltage generator.

18. A tunable bandstop filter device, comprising:

a main microwave transmission line;

at least one filter cell comprising a line segment coupled to the main microwave transmission line and arranged parallel to and remotely from the main microwave transmission line, and a tunable LC resonant circuit connected between one end of the line segment and the main microwave transmission line; wherein the main microwave transmission line is subdivided into at least two adjacent sections, the line segment being coupled to a first of said sections having a first electrical length, a second of said sections being free and of a second electrical length, the sum of first and second lengths being about a quarter-wavelength at the center rejection frequency of the filter.

19. A device according to claim 18, wherein the first length is about 3.3 mm, and the second length is about 1.7 mm when the center rejection is about 6 GHz.

20. A device according to claim 18, wherein the main microwave transmission line is further subdivided into a plurality of pairs of sections, a filter cell being associated with each pair.

21. A tunable microwave bandstop filter device having a center rejection frequency and comprising:

a main microwave transmission line;

at least one filter cell comprising a line segment coupled to said main transmission line and arranged parallel to and remotely from said main transmission line, and a tunable LC resonant circuit, said tunable LC resonant circuit being directly connected between one end of said coupled line segment and said main microwave transmission line, wherein said main microwave transmission line is subdivided into at least first and second adjacent sections, said first section being coupled to said coupled line segment and said second section being free from said coupled line segment, the first and second sections having together an electrical length substantially corresponding to a quarter-wavelength at said center rejection frequency of said filter.

22. A device according to claim 21, wherein the length of said first section is about 3.3 mm, and the length of said second section is about 1.7 mm when said center rejection frequency is about 6 GHz.

23. A device according to claim 21, wherein said main microwave transmission line is subdivided into a number of pairs of sections, a filter cell being associated with each pair.

* * * * *